US010190398B2

(12) United States Patent
Goodman et al.

(10) Patent No.: US 10,190,398 B2
(45) Date of Patent: Jan. 29, 2019

(54) DETONATOR STRUCTURE AND SYSTEM

(71) Applicant: Schlumberger Technology Corporation, Sugar Land, TX (US)

(72) Inventors: Kenneth Goodman, Richmond, TX (US); James Guilkey, Salt Lake City, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 353 days.

(21) Appl. No.: 14/901,586

(22) PCT Filed: Jun. 26, 2014

(86) PCT No.: PCT/US2014/044282
§ 371 (c)(1),
(2) Date: Dec. 28, 2015

(87) PCT Pub. No.: WO2014/210275
PCT Pub. Date: Dec. 31, 2014

(65) Prior Publication Data

US 2016/0376879 A1 Dec. 29, 2016

Related U.S. Application Data

(60) Provisional application No. 61/840,913, filed on Jun. 28, 2013.

(51) Int. Cl.
*E21B 43/117* (2006.01)
*E21B 43/1185* (2006.01)
(Continued)

(52) U.S. Cl.
CPC ..... *E21B 43/11855* (2013.01); *E21B 43/117* (2013.01); *E21B 43/1185* (2013.01); *F42D 1/043* (2013.01); *F42D 1/05* (2013.01)

(58) Field of Classification Search
CPC ..... F42D 1/043; F42D 1/05; E21B 43/117; E21B 43/1185; E21B 43/11855
See application file for complete search history.

(56) References Cited

U.S. PATENT DOCUMENTS 3,991,679 A * 11/1976 Savitt ..... F42D 1/04 102/275.4
4,608,926 A * 9/1986 Stevens ..... F42D 1/043 102/275.4

(Continued)

OTHER PUBLICATIONS

International Search Report and Written Opinion of International Application No. PCT/US2014/044282 dated Oct. 28, 2014, 13 pages.

(Continued)

*Primary Examiner* — Matthew R Buck
(74) *Attorney, Agent, or Firm* — Tim W. Curington

(57) ABSTRACT

A technique facilitates controlled detonation in well environments and other types of environments. Electronics for controlling detonation of a pellet of explosive material are mounted on a structure, such as a circuit board. The pellet is operatively coupled with the electronics and positioned to extend outwardly from the structure. Another explosive component is arranged across the pellet at a predetermined angle, e.g. a right angle, with respect to a longitudinal axis of the pellet. In well applications or other applications utilizing shaped charges, the explosive component may be coupled to the shaped charge via a detonator cord.

20 Claims, 3 Drawing Sheets

(51) Int. Cl.
*F42D 1/04* (2006.01)
*F42D 1/05* (2006.01)

(56) References Cited

U.S. PATENT DOCUMENTS

| | | | | |
|---|---|---|---|---|
| 4,716,832 | A * | 1/1988 | Sumner | C06C 7/00 102/275.1 |
| 4,928,595 | A | 5/1990 | Weingart | |
| 5,123,356 | A | 6/1992 | Brooks et al. | |
| 6,752,083 | B1 * | 6/2004 | Lerche | E21B 43/1185 102/202.5 |
| 8,056,632 | B2 * | 11/2011 | Goodman | F42C 15/42 166/297 |
| 2012/0227608 | A1 * | 9/2012 | Givens | F42B 3/121 102/311 |
| 2013/0042780 | A1 * | 2/2013 | Brooks | F42B 3/13 102/202.7 |

OTHER PUBLICATIONS

International Preliminary Report on Patentability of International Application No. PCT/US2014/044282 dated Jan. 7, 2016, 10 pages.

* cited by examiner

DETONATOR STRUCTURE AND SYSTEM

CROSS-REFERENCE TO RELATED APPLICATION

The present document is based on and claims priority to U.S. Provisional Application Ser. No. 61/840,913 filed Jun. 28, 2013, incorporated herein by reference.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed to control and enhance the efficiency of producing the various fluids from the reservoir. Additionally, perforating guns and shaped charges may be used to perforate the hydrocarbon-bearing formation for enhanced production of the reservoir fluids.

SUMMARY

In general, a system and methodology are provided to facilitate controlled detonation of charges, e.g. shaped charges, in a cost-efficient manner. Electronics for controlling detonation of a pellet of explosive material are mounted on a structure, such as a circuit board. The pellet is operatively coupled with the electronics and positioned to extend outwardly from the circuit board or other suitable structure. Another explosive component is arranged across the pellet at a predetermined angle, e.g. a right angle, with respect to a longitudinal axis of the pellet. In well applications or other applications utilizing shaped charges, the explosive component may be coupled to the shaped charge via, for example, a detonator cord.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
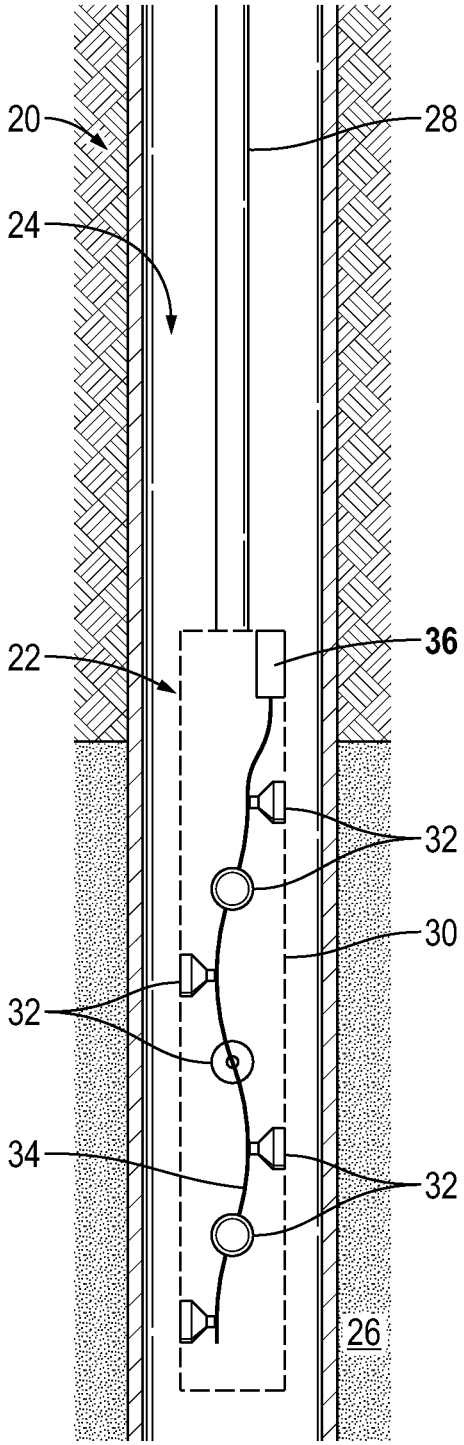
FIG. 1 is a schematic illustration of an example of a well system having a perforating gun deployed in a wellbore and comprising a detonator system for detonating shaped charges, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate controlled detonation of charges in a cost-efficient manner. For example, the system and methodology may be used in well applications to initiate detonation of shaped charges for perforation of a surrounding geologic formation. According to an embodiment, electronics are mounted on a structure to control detonation of a pellet of explosive material. In various applications, the electronics are mounted on a planar structure which may be in the form of a circuit board, e.g. a printed circuit board. The pellet is operatively coupled with the electronics and positioned to extend outwardly from the planar structure. Another explosive component is arranged across the pellet at a predetermined angle, e.g. a right angle, with respect to a longitudinal axis of the pellet. The explosive component may be part of or coupled with a detonator cord which is routed to the shaped charges of a perforating gun.

The technique described herein provides a cost-effective detonator system in a space efficient package by utilizing angled interaction of ballistic/explosive components rather than perpendicularly mounted circuit boards. Due to space constraints, conventional detonators often are long and skinny and this configuration previously dictated that certain electronics be mounted at right angles with respect to each other. For example, the control electronics may be mounted on a printed circuit board positioned along an axis of the perforating gun and at a right angle with respect to the electronics of an exploding foil initiator (EFI). In these conventional systems, the control electronics and the EFI electronics may be mounted on separate printed circuit boards or on a flexible printed circuit board bent at 90 degrees. The plane of the EFI is thus perpendicular to the axis of the perforating gun for coupling with a detonator cord in a space efficient manner. However, the right angled connection between the control electronics on the printed circuit board and the electronics of the EFI is a relatively difficult and expensive connection to construct.

In embodiments described herein, the angled turn, e.g. the right angled turn, which facilitates ultimate connection with the detonator cord or other suitable detonator device is accomplished via a ballistic connection instead of the electronic connection. The control electronics are mounted on a planar structure, e.g. a printed circuit board, and operatively engaged with a first explosive component, e.g. an explosive pellet, which extends outwardly from the planar structure. A second explosive component is laid across the first explosive component to achieve the desired angle, e.g. right angle, for ultimate connection with the detonator cord (or other suitable detonator) in a space efficient manner. The angled construction of ballistic/explosive components provides a dependable and inexpensive detonation system for detonation of shaped charges and other types of charges.

Referring generally to FIG. 1, an embodiment of a well system 20 is illustrated. In this embodiment, well system 20 comprises a perforating gun 22 which may be conveyed downhole into a wellbore 24 to a desirable location along a subterranean geologic formation 26. The perforating gun 22 may be conveyed downhole by a suitable conveyance 28, such as a wireline or other type of conveyance. The perforating gun 22 comprises a body or housing 30 which carries at least one and often a plurality of shaped charges 32.

The shaped charges 32 may be coupled with a detonator cord 34 or other suitable detonator device routed through housing 30. Once the perforating gun 22 is at a desired location in wellbore 24, the detonator cord 34 may be selectively detonated to cause detonation of those shaped charges 32 which are coupled with the detonator cord. In the example illustrated, a detonation system 36 is coupled to the detonator cord 34 to initiate detonation of the detonator cord 34 which, in turn, detonates the shaped charge or charges 32.

Figure 2:
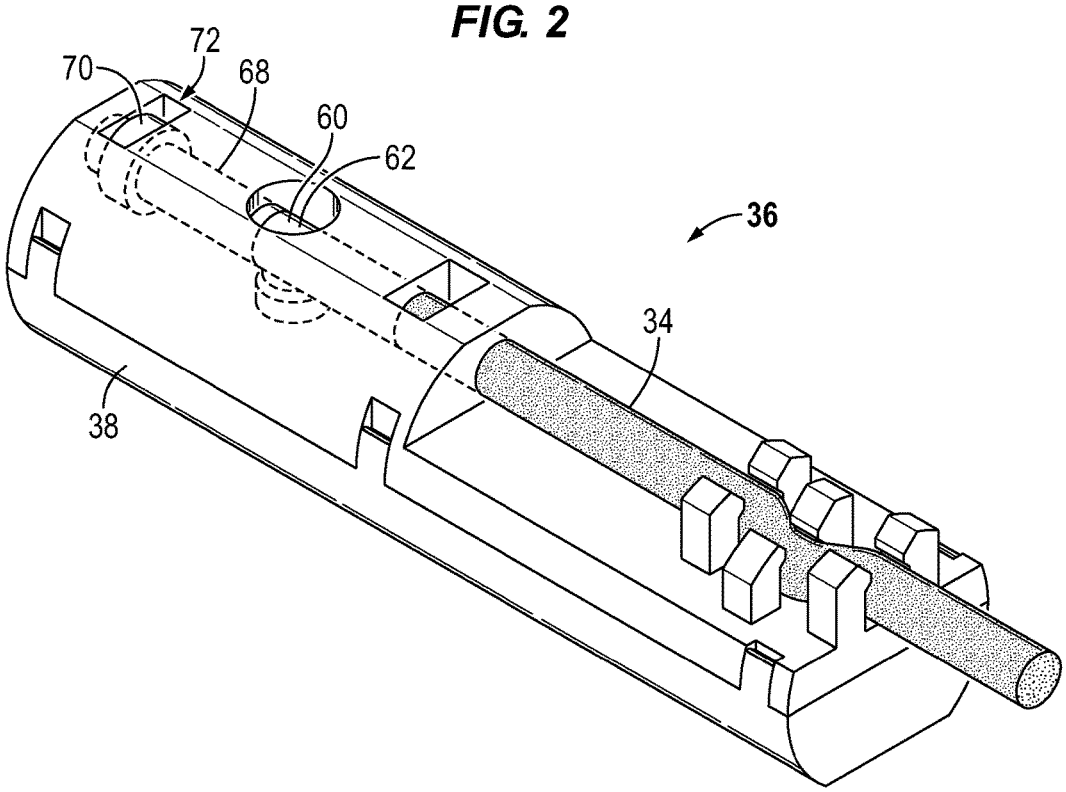
FIG. 2 is an orthogonal view of an example of the detonator system illustrated in FIG. 1, according to an embodiment of the disclosure.
Figure 3:
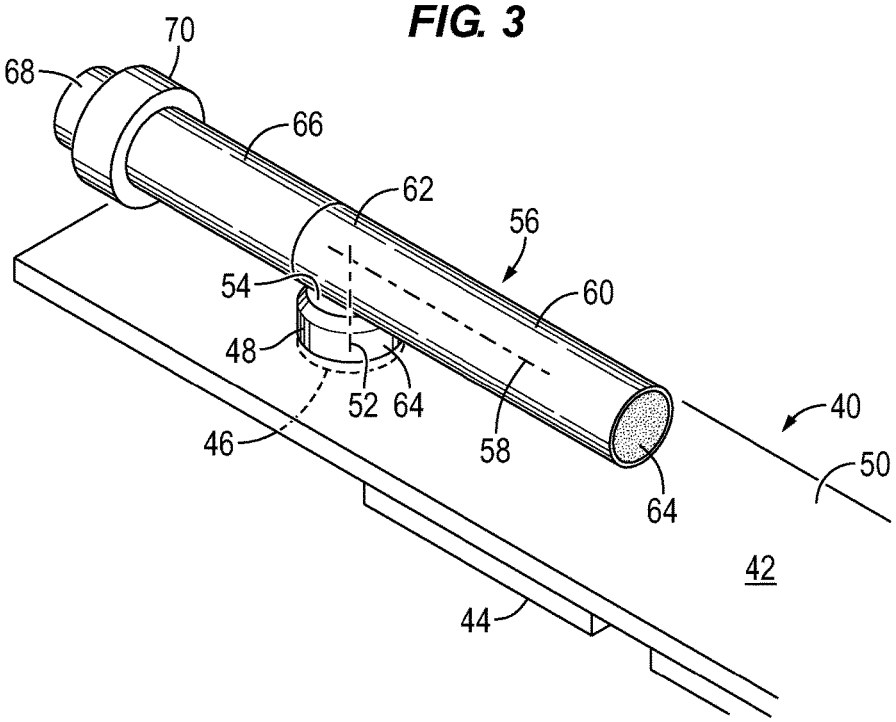
FIG. 3 is an orthogonal view of an example of a structure, e.g. circuit board, coupled with a first explosive component which, in turn, is coupled with a second explosive component of the detonator system, according to an embodiment of the disclosure.

Referring generally to FIGS. 2 and 3, an example of detonation system 36 is illustrated. In this example, various detonator system components illustrated in FIG. 3 are contained within a housing 38 as illustrated in FIG. 2. The housing 38 may comprise a two-part or multi-part housing which hinges or snaps together to enclose the various detonator system components. Additionally, the housing 38 may be constructed to receive and hold the detonator cord 34, as illustrated. In some applications, housing 38 is formed from plastic, e.g. an injection molded plastic, but housing 38 also may be formed from other suitable materials.

In the specific example illustrated in FIG. 3, the detonation system 36 comprises a structure 40 which is generally planar and sized for receipt within housing 38. The planar structure 40 may be in the form of a generally planar circuit board 42, such as a printed circuit board. Depending on the application, the circuit board 42 may be constructed from a rigid board, a flex board, a rigidflex board, or a combination of two or more of the rigid board, flex board, and rigidflex board. The structure 40/circuit board 42 carries electronics 44 which function to enable the selective control of electrical signals which are output to initiate detonation, as described in greater detail below. In some applications, the electronics 44 may comprise an exploding foil initiator (EFI) 46 to initiate detonation of explosive material.

As illustrated in FIG. 3, the detonator system components may further comprise a first explosive component 48 operatively engaged with the electronics 44, e.g. the first explosive component 48 may be engaged by EFI 46. In this example, the first explosive component 48 extends outwardly from the circuit board 42 and may be mounted on or through the circuit board 42. Depending on the application, the first explosive component 48 may be oriented at approximately a right angle with respect to a plane 50 in which the circuit board 42 lies. For example, the first explosive component 48 may have a longitudinal axis 52 arranged generally perpendicularly with respect to plane 50 of circuit board 42. In some applications, the first explosive component 48 is in the form of a pellet having a suitable cross-section, such as a circular cross-section.

The first explosive component 48 also comprises an engagement surface 54 oriented for engagement with a second explosive component 56. The second explosive component 56 is arranged at a predetermined angle with respect to first explosive component 48 to create a space efficient configuration. In some applications, for example, the second explosive component 56 is engaged with the first explosive component 48 at approximately a right angle although other angles may be used in some applications. In various space-efficient types of embodiments, a longitudinal axis 58 of the second explosive component 56 is generally perpendicular with the longitudinal axis 52 of first explosive component 48 such that the second explosive component 56 is generally parallel with circuit board 42 and plane 50. The first explosive component/pellet 48 and the second explosive component 56 comprise suitable explosive materials, such as explosive materials known and available to those of ordinary skill in the art. An example of explosive material includes explosive material used in conventional boosters employed in the well perforation industry.

Depending on the application, the second explosive component 56 may have a variety of forms and configurations, including the generally cylindrical form illustrated in FIG. 3. In an embodiment, the second explosive component 56 comprises a booster 60 engaged with first explosive component 48. The booster 60 may be a specially designed booster or a commercially available booster.

In some applications, a transfer donor 62 may be engaged with booster 60 or directly with detonator cord 34 such that electronics 44 initiate the sequential detonation of first explosive component 48, e.g. pellet 48, transfer donor 62, booster 60, and/or detonator cord 34. In this example, the pellet 48 effectively fires straight into the transfer donor 62, and the transfer donor 62 fires straight into the booster 60 or detonator cord 34. The second explosive component 56 may be positioned adjacent to or coupled with detonator cord 34, as illustrated in FIG. 2, such that detonation of the second explosive component 56 causes detonation of the detonator cord 34 and ultimately detonation of the shaped charge or charges 32. The first explosive component 48 and the second explosive component 56 are each formed with a suitable explosive material 64 available to those in the perforation industry.

In the example illustrated, the explosive material 64 of booster 60 (or of both booster 60 and transfer donor 62) may be positioned in a sleeve 66. The sleeve 66 is sized to receive a booster plug 68 which has an expanded feature 70. In some applications, the sleeve 66 is formed of aluminum, but it also may be formed of other suitable materials. The expanded feature 70 may be constructed for receipt in a corresponding recess 72 in housing 38 so that the second explosive component 56 is securely oriented and held within housing 38.

Figure 4:
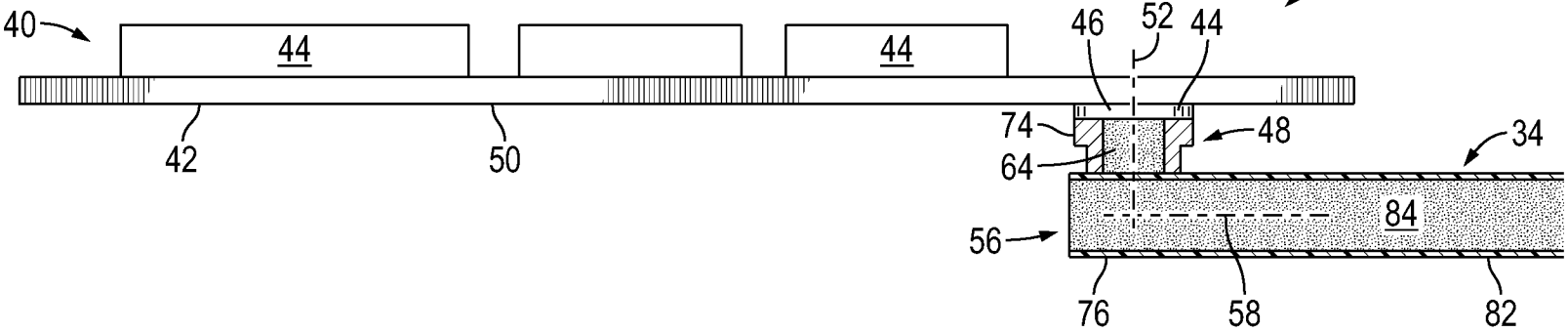
FIG. 4 is a cross-sectional view of another example of a detonator system, according to an embodiment of the disclosure.
Figure 5:
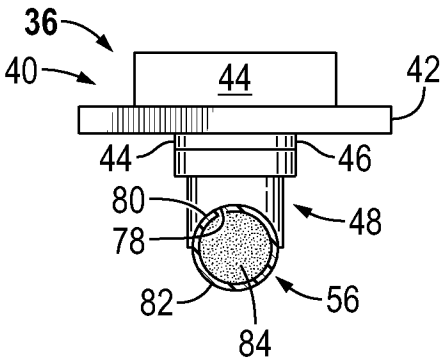
FIG. 5 is a cross-sectional view of the detonator system illustrated in FIG. 4 but taken along a plane generally perpendicular to the cross-sectional plane of FIG. 4, according to an embodiment of the disclosure.

Referring generally to FIGS. 4 and 5, another embodiment of detonation system 36 is illustrated. In this and other embodiments, the electronics 44 may comprise an initiator, such as EFI 46, coupled with standard EFI control circuitry. The EFI 46 is engaged with first explosive component 48. The first explosive component 48 is illustrated in the form of a pellet extending outwardly from circuit board 42 or another suitable structure 40. The first explosive component 48 may comprise explosive material 64 contained within a carrier 74 which is constructed from brass or another suitable material.

In this embodiment, the second explosive component 56 comprises an end 76 of detonator cord 34. The end 76 of detonator cord 34 is disposed across first explosive component/pellet 48 at a predetermined angle. For example, the axis 52 of the first explosive component 48 may be generally at a right angle with respect to circuit board 42, and the longitudinal axis 58 of the second explosive component 56 may be generally at a right angle with respect to first explosive component 48 and its longitudinal axis 52.

As illustrated in FIG. 5, the first explosive component 48 may have a curved surface 78 oriented for engagement with a corresponding curved surface 80. In some embodiments, curved surface 78 may be in the form of a portion of a circle, e.g. a semi-circle, sized to receive the curved side surface of end 76 of detonator cord 34. As illustrated, the detonator cord 34 may comprise an outer sleeve 82 which contains an explosive or combustible material 84. Material 84 is detonated by first explosive component 48 upon initiation via electronics 44.

Figure 6:
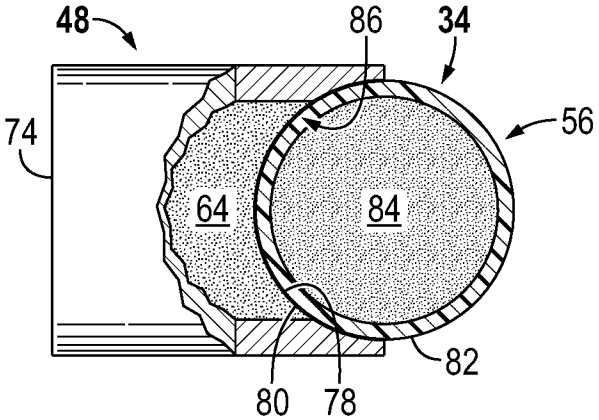
FIG. 6 is a view of another example of the first explosive component coupled with the second explosive component in which the first explosive component is arranged generally perpendicularly with respect to the second explosive component, according to an embodiment of the disclosure.

As illustrated in FIG. 6, the curved surface engagement between first explosive component 48 and second explosive component 56 may be achieved with a variety of curves and component configurations. In these configurations, the angle transition, e.g. right angle transition, is achieved through ballistic transfer using pellet 48 which has a concave feature 86, e.g. curved surface 78. The curved output side of the pellet 48 conforms to an outside diameter, e.g. corresponding curved surface 80, of detonator cord 34. In this example, the housing 38 may be used to firmly hold the outer case or sleeve 82 of the detonator cord 34 against the explosive material 64 within first explosive component/pellet 48 but generally at a right angle with respect to pellet 48. This allows the EFI 46 or other initiator to be oriented along the same plane 50 as circuit board 42, as illustrated in FIGS. 3-5.

The curved surface 78 and corresponding curved surface 80 increase the ballistic transfer efficiency in many applications. However, other applications may utilize a flat or a substantially flat engagement surface 54 as with the embodiment illustrated in FIG. 3. In various embodiments, the engagement surfaces 54, 78 which engage booster 60, transfer donor 62, and/or detonator cord end 76 of the second explosive component 56 may be generally flat, convex, concave, or of other suitable surface shape.

The system 20, e.g. well system, may be used in a variety of applications, including numerous well perforation applications and other applications utilizing controlled detonation of shaped charges or other charges. For example, the detonation system 36 and a suitable overall system 20 may be used in well applications, mining applications, and various other applications which benefit from a controlled, dependable detonation. Depending on the specifics of a given application, the construction of the overall system 20 and detonation system 36 may vary. Additionally, the system 20 may be designed for use in many types of wells, including vertical wells and deviated, e.g. horizontal, wells. The wells may be drilled in a variety of formations with single or multiple production zones and with many different types of perforating gun systems constructed to form various types of perforations in the production zones of the geologic formation.

Depending on the application, the detonation system 36 may be constructed in several configurations. For example, the electronics 44 and supporting structure 40 may have a variety of sizes, components and configurations. Depending on the application, the electronics 44 may be controlled by signals sent downhole from a surface control system via various communication lines or wireless techniques. Additionally, the first explosive component 48 and the second explosive component 56 may be operatively engaged via a variety of techniques and components. For example, the components may be held in contact or near contact by housing 38 and/or by other mounting structures. The types of explosive material 64 and the configuration of that explosive material also may be adjusted according to the parameters of a given application. Similarly, the second explosive component 56 may have a variety of components, including boosters, transfer donors, detonator cord ends, and various combinations of these components and/or other suitable components.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for perforating, comprising:
- a perforating gun having a shaped charge;
- a detonator cord coupled to the shaped charge; and
- a detonator system coupled to the detonator cord to initiate detonation of the detonator cord for ultimate detonation of the shaped charge, the detonator system comprising:
  - a circuit board lying generally along a plane and having electronics;
  - a first explosive component engaged with the electronics and extending from the circuit board, wherein the first explosive component has a first longitudinal axis; and
  - a second explosive component having a second longitudinal axis, the second explosive component being engaged with the first explosive component such that the second longitudinal axis being approximately perpendicular to the first longitudinal axis, the electronics being controlled to initiate explosion of the first explosive component which, in turn, initiates explosion of the second explosive component to cause detonation of the detonating cord and the shaped charge.

2. The system as recited in claim 1, wherein the first explosive component extends from the circuit board at approximately a right angle with respect to the plane, further wherein the electronics comprise an exploding foil initiator (EFI).

3. The system as recited in claim 1, wherein the first explosive component comprises an explosive pellet mounted to the circuit board.

4. The system as recited in claim 1, wherein the second explosive component comprises an end of the detonator cord.

5. The system as recited in claim 1, wherein the second explosive component comprises a booster engaged with the detonator cord.

6. The system as recited in claim 1, wherein the second explosive component comprises a transfer donor connected to a booster which, in turn, is engaged with the detonator cord.

7. The system as recited in claim 1, wherein the first explosive component has a curved surface engaging the second explosive component.

8. The system as recited in claim 1, wherein the second explosive component comprises an end of the detonator cord and the first explosive component has a curved surface with a curvature for receiving a corresponding curved surface of the end of the detonator cord.

9. The system as recited in claim 1, wherein the circuit board comprises at least one of a rigid board, a flex board, and a rigidflex board.

10. A system for initiating a detonation, comprising:
- a circuit board having electronics for initiating detonation of explosive material;

a pellet formed from the explosive material and extending from the circuit board along a first longitudinal axis, the pellet being coupled with the electronics; and an explosive component having a second longitudinal axis positioned approximately perpendicular to the first longitudinal axis of the pellet such that the explosive component extends along a portion of the circuit board at a position spaced from the circuit board, the electronics being controllable to initiate detonation of the pellet which, in turn, initiates detonation of the explosive component.

11. The system as recited in claim 10, wherein the pellet and the explosive component have respective axes which extend at generally right angles with respect to each other.

12. The system as recited in claim 11, wherein the pellet extends at generally a right angle with respect to the circuit board.

13. The system as recited in claim 10, wherein the explosive component comprises an end of a detonator cord.

14. The system as recited in claim 13, wherein the detonator cord is coupled with a shaped charge.

15. The system as recited in claim 10, wherein the explosive component comprises a booster.

16. The system as recited in claim 10, wherein the explosive component comprises a transfer donor.

17. The system as recited in claim 10, wherein the pellet engages the explosive component along a curved surface.

18. A method, comprising:

positioning a pellet of explosive material so as to extend outwardly along a first longitudinal axis from a structure carrying electronics;

coupling the electronics to the pellet in a manner to enable selective detonation of the pellet;

arranging an explosive component having a second longitudinal axis across the pellet approximately perpendicular to the first longitudinal axis of the pellet; and coupling the explosive component to a shaped charge.

19. The method as recited in claim 18, wherein coupling comprises coupling the explosive component to the shaped charge with a detonator cord.

20. The method as recited in claim 19, further comprising running the shaped charge downhole into a wellbore.

* * * * *